United States Patent [19]

Murakami et al.

[11] Patent Number: 4,978,045

[45] Date of Patent: Dec. 18, 1990

[54] SHEET STAPLER

[75] Inventors: Koichi Murakami; Masakazu Hiroi, both of Yokohama, Japan

[73] Assignee: Canon Kabushiki Kaisha, Tokyo, Japan

[21] Appl. No.: 496,137

[22] Filed: Mar. 19, 1990

Related U.S. Application Data

[63] Continuation of Ser. No. 270,048, Nov. 14, 1988, abandoned.

[30] Foreign Application Priority Data

| | | | |
|---|---|---|---|
| Nov. 16, 1987 | [JP] | Japan | 63-290294 |
| Dec. 2, 1987 | [JP] | Japan | 63-305410 |
| Dec. 9, 1987 | [JP] | Japan | 63-312909 |

[51] Int. Cl.[5] ..... B25C 5/04; B27F 7/21

[52] U.S. Cl. ..... 227/1; 227/85; 227/120; 226/45

[58] Field of Search ..... 227/1, 2, 85, 114, 120, 227/121, 135, 136, 137; 83/345; 226/45

[56] References Cited

U.S. PATENT DOCUMENTS

| | | | |
|---|---|---|---|
| 4,484,079 | 11/1984 | Betz et al. | 226/45 X |
| 4,523,750 | 6/1985 | Hubler | 227/2 X |
| 4,573,625 | 3/1986 | Olesen et al. | 227/86 X |
| 4,770,334 | 9/1988 | Hoshi et al. | 227/85 |

*Primary Examiner*—Paul A. Bell
*Assistant Examiner*—James Wolfe
*Attorney, Agent, or Firm*—Fitzpatrick, Cella, Harper & Scinto

[57] ABSTRACT

A sheet stapler apparatus including a cartridge for containing a belt of connected staple wires, a movement confining device provided in the cartridge for confining movement of the staple wires, and a device for stapling sheet materials with the leading staple wire from the belt. A device feeds the staple wires out of the cartridge to the stapling device, and a detecting device detects when the staple supply in the cartridge is almost empty. A control device, responsive to the detecting device, prohibits feeding of the belt by the feeding device, at which time the movement confining device acts on the staples to keep them in the cartridge.

16 Claims, 13 Drawing Sheets

SHEET STAPLER

This application is a continuation of application Ser. No. 07/270,048 filed Nov. 14, 1988, now abandoned.

FIELD OF THE INVENTION AND RELATED ART

The present invention relates to a sheet stapler for stapling sheets.

U.S. Pat. No. 4,573,625 discloses a stapler which comprises a detachably mountable staple cartridge, a stapling mechanism and driving means, wherein a part of the stapling mechanism is opened (when the stapling mechanism is at its home position). The sheets to be stapled are inserted into open space, and when a sheet detecting means detects the sheets, the stapler operates to staple the sheets. With repetition of the stapling operations, a belt of staple blanks is advanced correspondingly.

In order to detect the necessity of a cartridge change, a sensor is provided to detect a last blank of the staple remaining in the cartridge passing by a predetermined position in the cartridge. However, even when the sensor detects the last edge of the belt, staple blanks still remain, and the stapling operation is not prohibited as yet and stapling can continue by actuating the stapler.

If the cartridge is exchanged with a fresh one immediately after the sensor detects the last blank, a small number of blanks remaining in the cartridge fall from the cartridge when the used cartridge is retracted, and therefore, the fallen blanks may remain in the stapler. This requires the operator to remove those blanks before the fresh cartridge is mounted. If the fresh cartridge is mounted into the stapler without removing those fallen blanks, the remaining blanks can cause erroneous stapling and staple jam.

A system wherein the trailing edge of a belt of staples is detected optically, using light reflection from the staple can be accomplished without difficulty at relatively low cost, but it is difficult to stabely detect the staplers because of the peculiar property of the staples. More particularly, the staplers are accommodated in a staple cartridge in the form of a belt, and the staples are bonded adjacent their center portions, and the bonded portions are different in color from that of the staples. Therefore, the light reflected by the belt of the staples at this portions is weak, and therefore, there is a liability of erroneous operation.

SUMMARY OF THE INVENTION

Accordingly, it is a principal object of the present invention to provide a sheet stapler wherein when a user replaces the cartridge set in the stapler with a fresh cartridge, the remaining part of the belt of staples remaining in the stapler are also retracted together with cartridge, and therefore, the staples of only the new cartridge can be mounted in the stapler with certainty, whereby the malfunction of the staple feeding mechanism and the occurrence of the staple jam can be prevented.

According to an embodiment of the present invention, there is provided a sheet stapler, comprising a cartridge accommodating a belt of staples, confining means provided in the cartridge for confining movement of the belt of staples relative to the cartridge, means for sequentially stapling sheets from the lead staple of the belt, staple feeding means for feeding the belt of staples to the stapling means against the movement confining means, remaining amount detecting means for detecting a predetermined remaining amount of the staples in the cartridge to produce a signal, and means for prohibiting feeding of the staples while the belt of staples is confined by said confining means.

It is another object of the present invention to provide a sheet stapler wherein a staple detecting sensor provided which receives light which is distinguishes whether there staples and when there is not.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Figure 2:
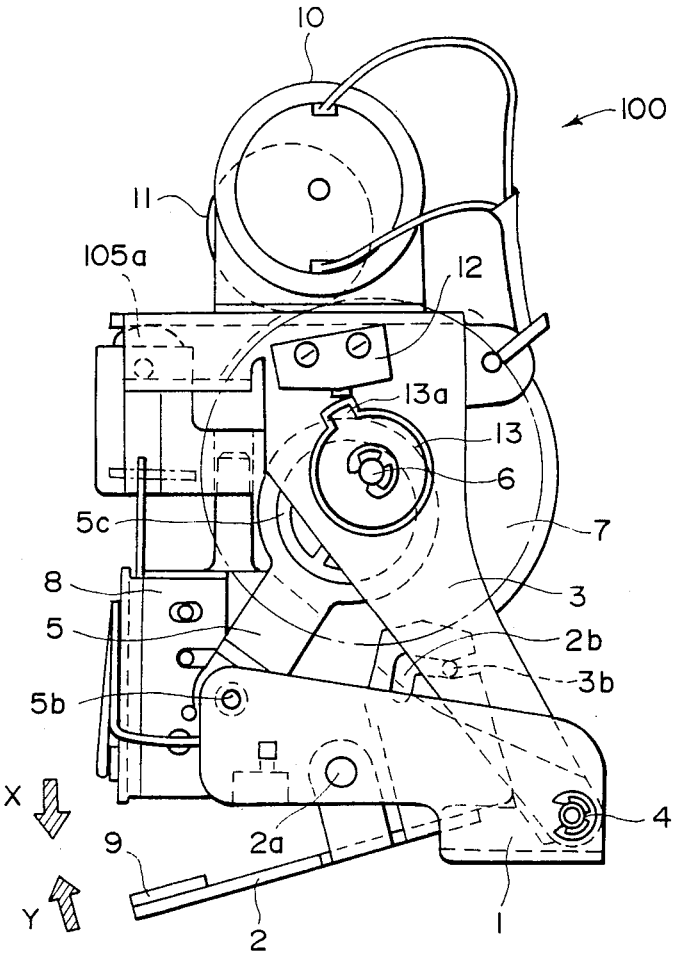
FIG. 2 is a side view showing a general arrangement of the stapler.
Figure 3:
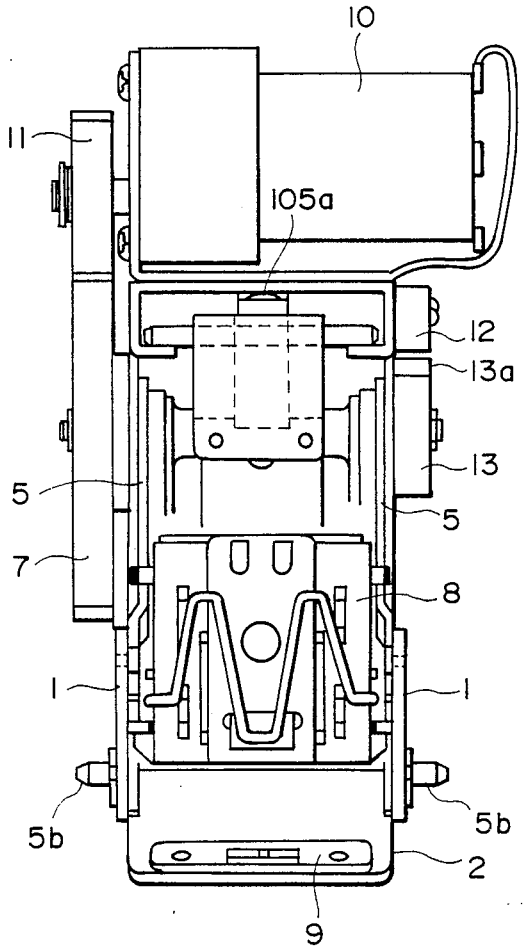
FIG. 3 is a front view of the stapler wing a general arrangement of the stapler.

Referring to FIGS. 2 and 3, there is shown a front view and a side view of a stapler apparatus according to an embodiment of the present invention. The stapler apparatus 100 comprises a base 1 (FIG. 2) for supporting the stapler 100 and a lower jaw 2 pivotable about a *2a*. At an end of the lower jaw 2, a channel-shaped cam *2a* is formed which is engaged with a pin *3b* mounted to an upper unit 3. The upper unit 3 is swingably supported on a hinge pin 4 mounted on the base 1. A cramp arm 5 is rotatably supported on a part of the base 1 by a pin *5b* provided adjacent an end thereof. The other end thereof is engaged with a cam plate *5c* eccentrically mounted on the driving shaft 6, so that the cam plate 5c rotates about a pin 6 when a stapler gear 7 rotates through one full turn. At this time, the base 1 is fixed, and the distance between the shaft 5b and the pin 6 is constant, and therefore, the upper unit 3 rotates about the hinge pin 4 relative to the base. A body 8 is pushed downwardly from the upper unit at the head 105a of a driver mounted to the body, so that it rotates about the hinge pin 4 in the direction indicated by a reference x (the body 8 is rotatably supported on a hinge pin 4). Simultaneously, the lower jaw 2 rotates about the pin 2a in the direction Y by the channel shaped cam 2b of the lower jaw engaged with the cramping pin 3b of the upper unit 3. The base 1 is provided with an anvil 9 for bending leading edges of legs of a staple toward each other.

To an upper portion of the upper unit 3, a motor 10 which is the driving source for the stapler mechanism is mounted, and the driving force is transmitted to the stapler gear 7 therefrom through a motor gear 11. The apparatus further comprises a home position sensor 12 in the form of a microswitch for detecting the home position of the stapler wherein the stapler 100 is in a stand-by state, that is, in which the body 8 and the lower jaw 2 are spaced apart. When the stapler gear 7 rotates through one full turn, the sensor cam 13 rotates through one full turn in synchronism therewith, and a projection 13b of the sensor cam 13 actuates the microswitch 12 to detect the home position of the stapler 100. When the stapler gear 7 rotates through one full turn, the stapler completes one stapling cycle.

Figure 1:
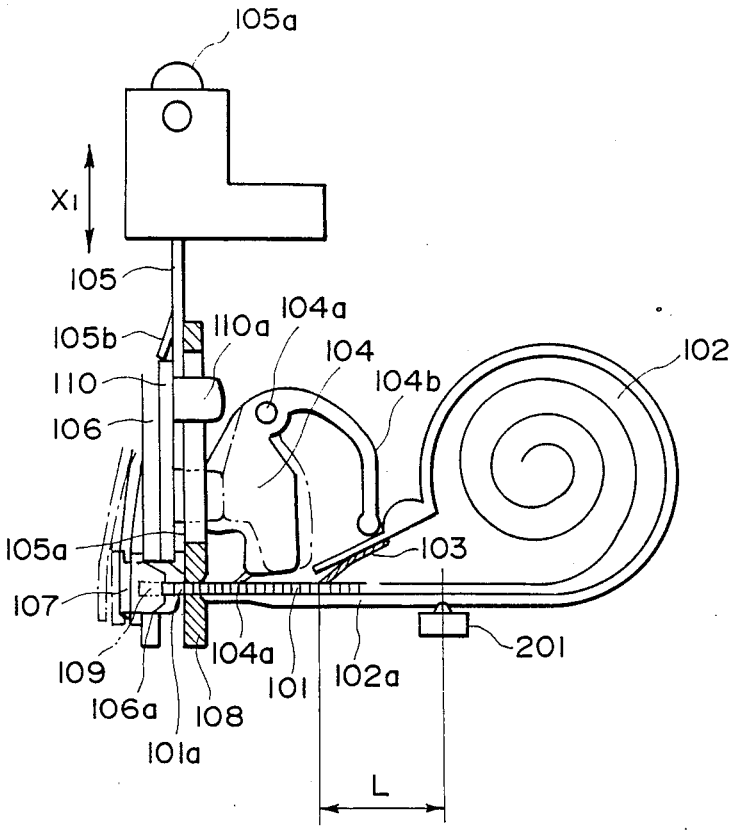
FIG. 1 is a side view showing a major portion of a sheet stapler according to an embodiment of the present invention.
Figure 4:
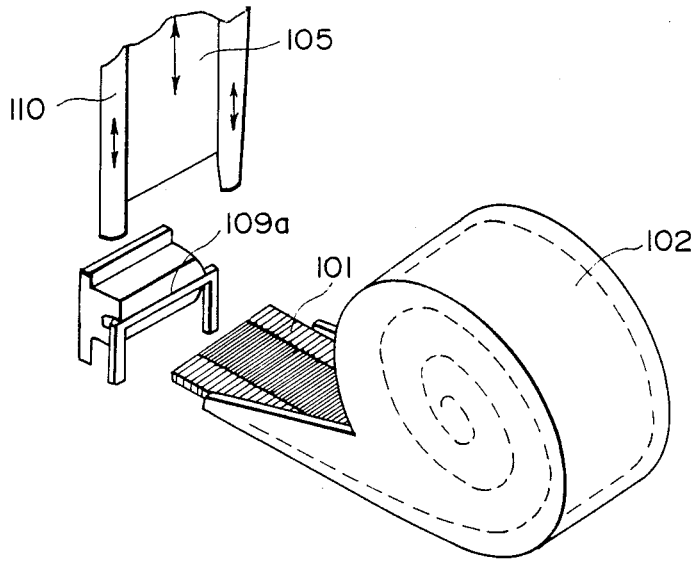
FIG. 4 is a perspective view illustrating a stapling section.

Referring to FIG. 1, the description will be made as to the stapling mechanism. FIG. 1 is a detailed sectional view of a staple feeding and stapling stations of the body 8. Reference numeral 101 designates staples which are bonded adjacent their central portion and are formed into a belt accommodated in a cartridge 102. The cartridge is provided with movement confining means in the form of a leaf spring 103 fixedly mounted to the cartridge. It is effective to urge the belt of the staples to a guide 102a of the cartridge 102 under appropirate pressure to retain and guide the belts. A driver 105 functioning as stapling means serves to separate a staple from the belt of the staples, and to press it into the set of sheets down to the anvil 9. The head 105a of the driver 105 contacts the upper unit 3, as described hereinbefore, and when the upper unit 3 rotates, the driver head 105a is pushed downwardly, more particularly, in a direction $x_1$ in FIG. 1. At this time, the leading wire of the staples or blanks of staples is held at its central portion by the groove 109a provided in a blank bending block 110, as shown in FIG. 4. Simultaneously with downward movement of the driver head 105a, the bending block 110 moves downwardly, by which the block 110 abuts opposite ends of the blank to bend it into a channel shape, that is, a staple shape. When the driver head 105a is further urged, a projection 110a of the bending block 110 pushes the staple feeding member 104 supported rotatably on a pin 104a, and the staple feeding member flexes a spring 104b and moves to a position indicated by chain lines. With this, a staple feeding pawl 104a moves in a direction opposite to the staple feeding direction. Since the leading staple wire 101a has already been bent, it does not move in the opposite direction, and therefore, only the feeding pawl 104a moves in the opposite direction to be prepared for the next staple feeding. When the driver head 105a moves further downwardly, the block pushing pawl 105b of the driver 105 is disengaged from the upper portion of the bending block 110, and only the driver 105 moves downwardly. The leading edge 105a of the driver reaches a tapered portion of the block 110, and with further downward movement, it pushes against a spring 107 toward showing the chain line position the blank bending block 109 supported in the opening 106a of the block guide 106, and cooperates with a staple cutting member 109 to separate the lead staple from the other blanks of the belt to press the staple 101a into the sheets. After the stapling operation, the driver head 105a is returned to its upper position, and simultaneously, the projection 110a is disengaged from the member 104, and the staple feeding pawl 104a is returned to the original position. During this, the belt of the blank wires advances. This is a stapling cycle. In FIG. 1, there is provided a staple detecting sensor 201 which is away from the staple confining member 103 by a distance L.

Figure 8:
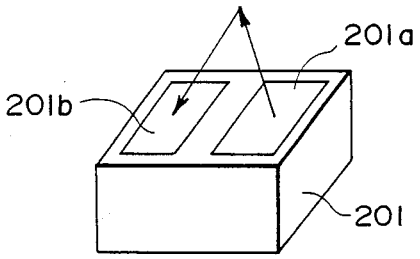
FIG. 8 is a perspective view of a reflection type sensor.
Figure 9:
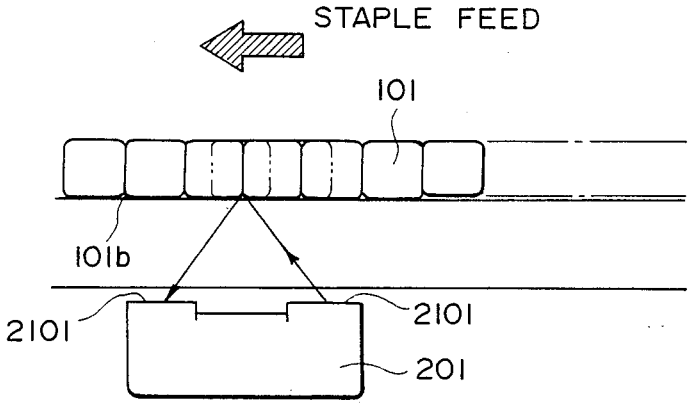
FIG. 9 illustrates a relationship between a reflection type sensor and a needle.

Referring to FIGS. 8 and 9, the description will be made as to detection of the staples in the staple cartridge, wherein reference numeral 201 designates a remaining amount detecting means in the form of a reflection type sensor for electrically detecting presence or absence of the staple.

Figure 5:
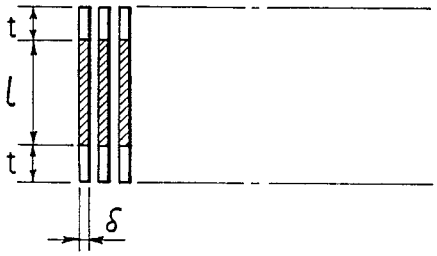
FIG. 5 shows staples.
Figure 6:
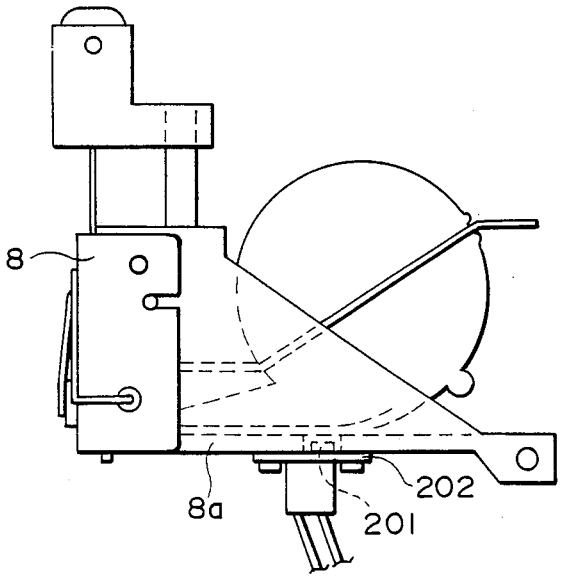
FIGS. 6 and 7 illustrates mounting of the staple sensor.
Figure 7:
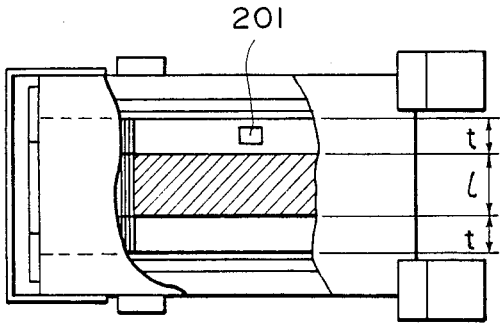

As shown in FIG. 8, in the structure of the present embodiment, use is made as a reflection type sensor comprising a light emitting element 201a and a light receiving element 201b for receiving the light emitted from the light emitting element 201a and then reflected by a member to produce a voltage. As shown in FIG. 5, the staples 101 or blanks of staples are bonded at their central portions into a belt, and the region 1 in which they are bonded are different in color due to the influence of a bonding agent, and generally, the color thereof is different from the background color (silver) to somewhat yellow.

Figure 14:
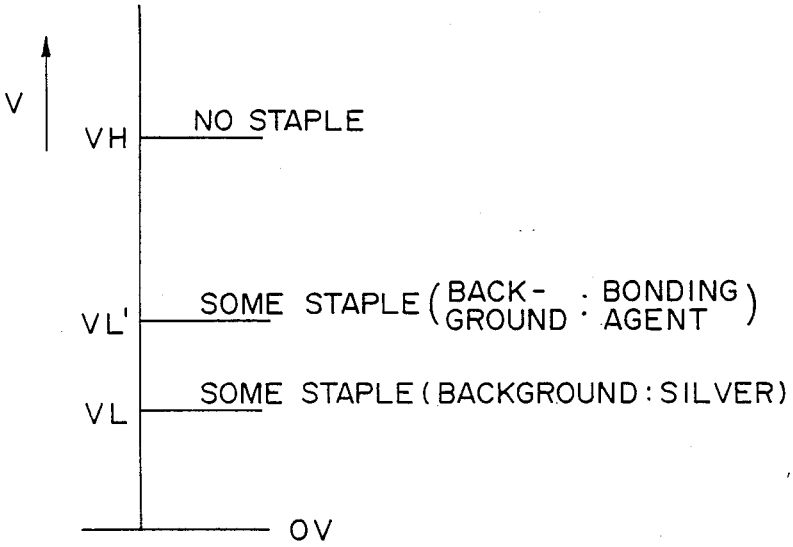
FIG. 14 is a graph illustrating various regions of the output voltage of the reflection type sensor.

FIG. 14 shows output voltage of the reflection type staple detecting sensor 32. As will be understood from this Figure, an output voltage VL when the sensor receives the light reflected by edge portion t having a high reflection index silver color of the staple 22, is lower than the output voltage VL' when it receives the light reflected from the region 1 of the bonding agent, and is different from the voltage VH produced when there is no staple. Therefore, the silver color providing a higher reflection index is more suitable for detection of presence or absence of the staples because it provides a S/N ratio (signal-noise ratio) other than the yellow color. It is also more reliable against dust or contaminations to avoid erroneous detection. Particularly, the cartridge used in this embodiment is provided with a covering made of plastic resin, and the staples are accommodated therein. Therefore, it is usual that the reflection type sensor 201 is disposed outside the covering. In consideration of the random reflection of light by the plastic resin material, it is very desirable for the increase in reliability that the staple is detected on the basis of the silver color portion. In this embodiment, the reflection sensor 201, the base 202 and a connector 203 are mounted to the bottom of the body 8, and the region corresponds to the region t of FIG. 5 for the silver color region of the staple.

Figure 10:
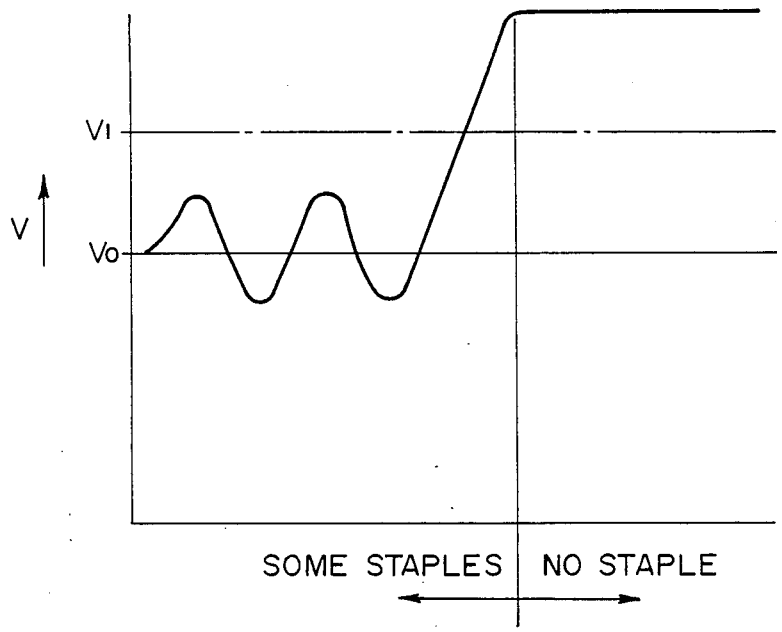
FIG. 10 is a graph showing an output voltage of the reflection type sensor.

FIG. 9 shows in detail the relationship between the reflection type sensor 201 and the staple 101. Since the staples are bonded, there are recesses 101b between staples (blanks) as seen in section. FIG. 10 shows an output voltage of the staple sensor when it detects the staples. As will be understood from this Figure, the output voltage is in the form of a wave due to the change of the reflection index in the concave and convex portions. If the presence or absence of the staples is detected only on the basis of the change of the voltage, the voltage level is increase at a portion 101*b* between staples, and there is a liability that the absence of the staples is erroneously detected. In order to avoid this, in the present embodiment, the absence of the staples is detected when the voltage exceeds a predetermined level (V1), and the voltage is stabilized, whereas the presence of the staples is detected when the voltage is not higher than a lever V0.

The description will be made as to the position of the reflection type sensor in the direction of the staple feeding. In this embodiment, the staples are accommodated in a cartridge, and therefore, the new cartridge has to replace the old cartridge if it becomes empty. However, in the structure of this embodiment (FIG. 1), the reflection type sensor 201 is positioned at a predetermined distance from the lead stable 101*a*. Therefore, if the reflection type sensor 201 detects the absence of the staples, in immediate response to it, the stapler electrically stops, and therefore the remaining staples are not usable. In view of this, it is desirable that the apparatus is kept operative until a certain number of operating cycles after detection of the absence by the sensor 201. However, in the structure wherein the feeding pawl mechanism is used, the staple feeding is disabled when the trailing edge of the belt passes by the staple feeding pawl 104*a*, which is the staple feeding mechanism. Even if the stapler is operated under the condition that the staple feeding is disabled, the staple is not dispensed. If the cartridge is then exchanged with a fresh cartridge, the small number of staples which can not be fed remain in the stapler when the old cartridge is taken out of the apparatus. If an attempt is made to load the new cartridge into the stapler, the remaining staples in the old cartridge are moved by the new cartridge, with the result that the arrangement of the staples in the form of the belt is disturbed in the apparatus. This can cause trouble in feeding staples and staple jam in the following staple feeding operations. Therefore, the remaining staples should be removed together with the old cartridge upon replacement of the cartridge. In the structure of this embodiment, the staple cartridge 102 is provided with a staple confining member 103. When the cartridge is removed under the condition that the staples are retained by the confining member 103, the remaining staples are removed from the apparatus together with the cartridge. The position of the reflection sensor 201 is away from the staple confining member 103 by a distance L in the direction of the staple feeding. Further, in order to use the as staples as possible, a number (n, $n>0$) stapling operations are permitted after the absence of the staple is detected by the sensor 201, the number n being determined such that the trailing edge of the belt is confined by the confining member 103, and that the stapling operation is electrically prevented when the number of stapling operations exceeds n, that is, when the remaining number of the staples reach a predetermined position. In order to accomplish this, the distance L between the reflection sensor 201 and the staple confining member 103 is larger than a width 8 of one staple as shown in FIG. 4 multiplied by the above number n, that is, $L>n\times 8$.

Figure 11:
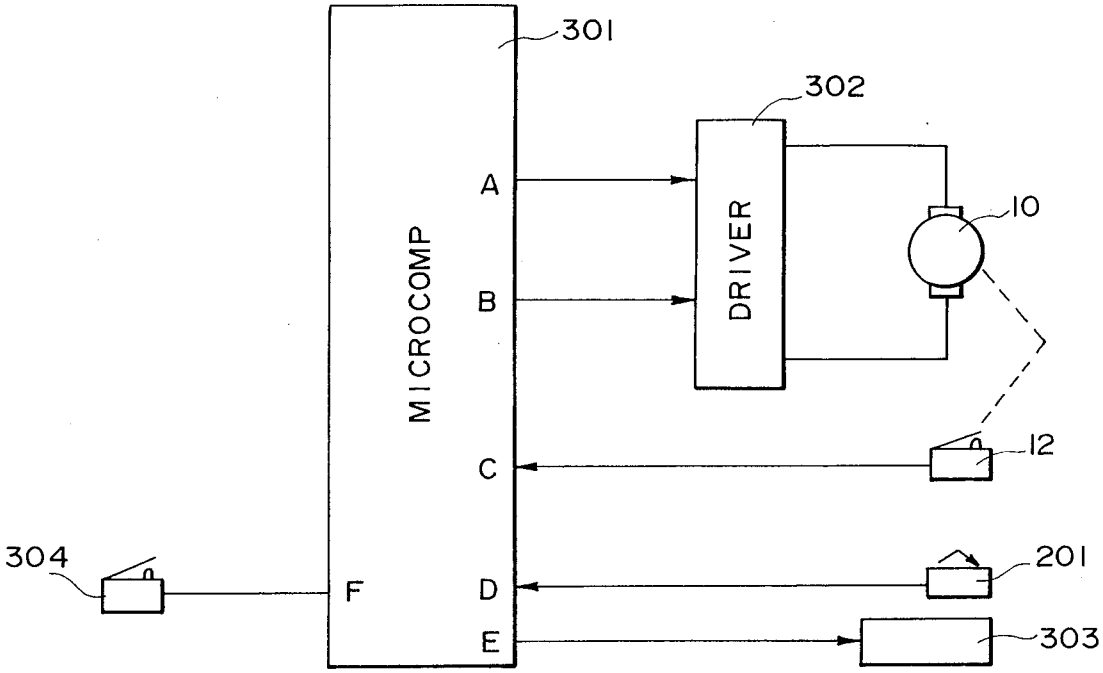
FIG. 11 is a block diagram illustrating a control system for the apparatus according to the embodiment.

Referring to FIG. 11 which is an electric circuit block diagram, the control system will be described. The control system includes a control circuit 301 including staple feed prohibiting means and is, for example, in the form of a microcomputer containing a program for sequential control. The terminals A and B of the control circuit 301 are output terminals for forward and backward rotations of the motor 10, respectively. The outputs thereof are supplied to a forward-backward driver 302. When the output of the terminal A is high, a normal stapling operation is performed, whereas when the output of the terminal B is high due to overload of the motor 10 or the like, a reverse operation is performed. When the stapler is in the home position normally, the microswitch 12 which is a home position sensor is closed (O), and the signal thereof is supplied to a terminal C of the control circuit 301. The forward-backward driver 302 is constructed such that irrespective of the direction of rotation of the motor, the motor is instantaneously stopped in response to the microswitch 12. When the apparatus is not operated, the lower jaw 2 of the stapler is always disposed adjacent the bottom-most position, as shown in FIG. 1. Thus, a stabilized stapling operation and the easiness of the recovery manipulation after the reverse operation, are assured.

An output of the reflection sensor 201 is supplied to a terminal D of the control circuit 301, and the signal is an analog one, and therefore, in this embodiment, the microcomputer has a function of converting the analog data into digital data.

A signal indicative of absence of the staples is supplied from a terminal E to a display device 303, in response to which the display device 303 displays the emptiness.

From a terminal F, a signal from a stapling operation starting switch 304 is supplied.

Figure 12:
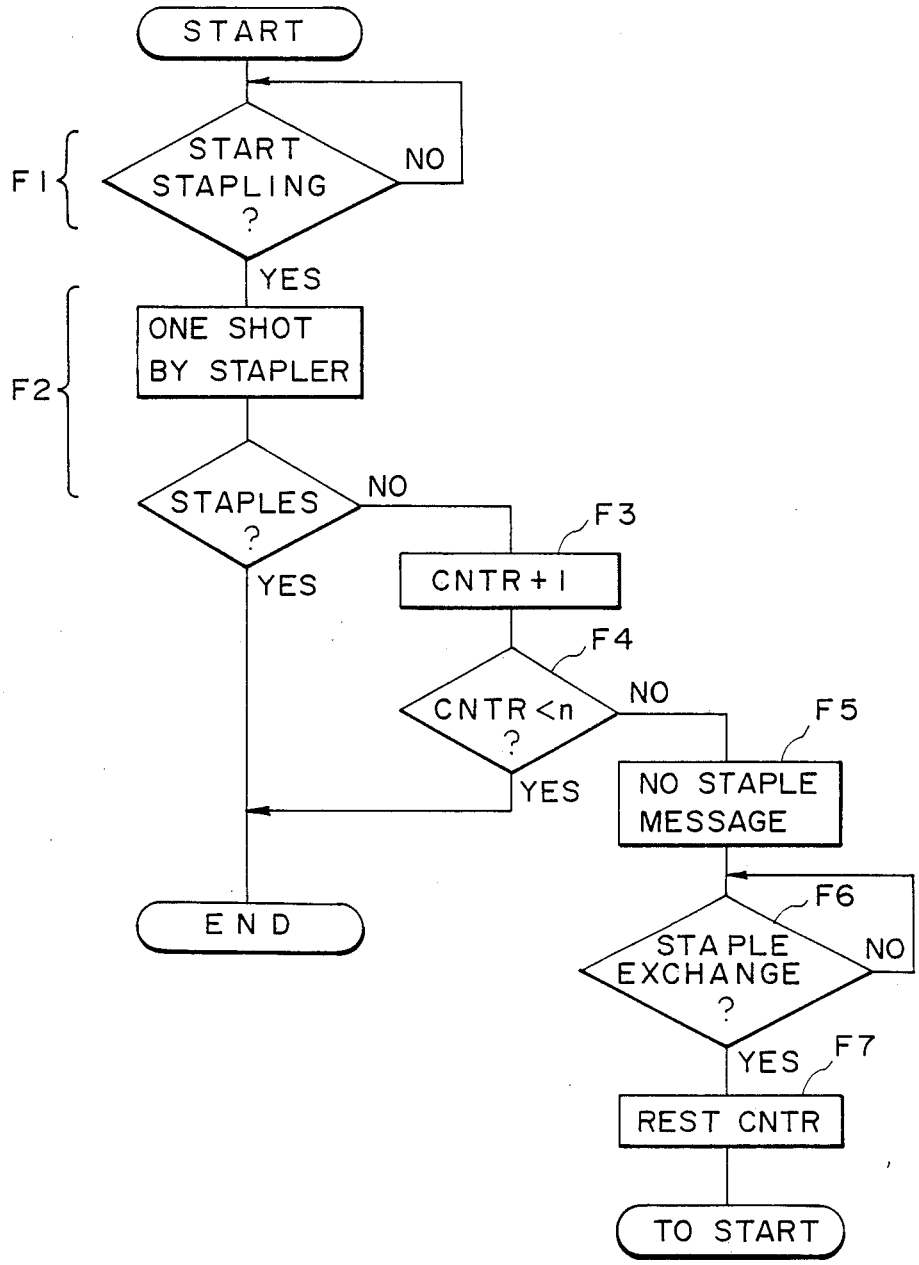
FIG. 12 is a flow chart illustrating operation of the apparatus.

Referring to FIG. 12, the description will be made as to the operation of the apparatus according to this embodiment. When production of a staple operation starting signal is discriminated on the basis of the switch 304 at step F1, one stapling cycle operation is performed at step F2, and the absence and presence of the staples in the staple cartridge is discriminated on the basis of the output of the sensor 201 after the operational cycle. If there are staples, the operation ends in good order, but if emptiness is detected, the sequence goes to step F3, where the counting operation is performed as to how many times the stapling operations are carried out after absence of the staple, and the counter is incremented by one after the detection of the emptiness. At step 4, the count is compared with a predetermined integer number n. If it is smaller than n, the operation ends, and the apparatus waits for the next stapling operation. If, however, if the count equals to n, the sequence goes to step F5 where the emptiness is transmitted to the display device 303 to inform it to the operator.

Until the staple replenishment operation is carried out, the sequence stops at the step F6 so that the stapling operation is prohibited. The detection of the completion of the staple replenishment is accomplished by detecting the presence of the staples by the reflecting sensor 201.

After the replenishment of the staples, the counter is reset at step F7, and sequence goes back to the start.

In this embodiment, the staple detecting means is in the form of a reflection type sensor, but this is not limiting, and alternatively, a magnetic type sensor is usable in view of the face that the staples are made of magnetic material. As another alternative, it can be detected by a mechanical contact sensor in which a part of the cartridge is cut-away.

The stapling operation starts may be instructed by a manual switch or may be instructed by a detection signal which is a switch for detecting the sheets inserted into the space between the lower jaw 2 and the upper unit 3.

It may be desirable that when the sensor 201 fails to detect the staples, the number corresponding to n minus the count, that is, how may stapling operations are possible, is displayed on the display device 303.

The stapler of this embodiment has many advantages when is usable with a general electric stapler, but it is also usable with a finisher or a sorter connected with a copying machine or the like to automatically staple the sheets discharged therefrom.

Figure 13:
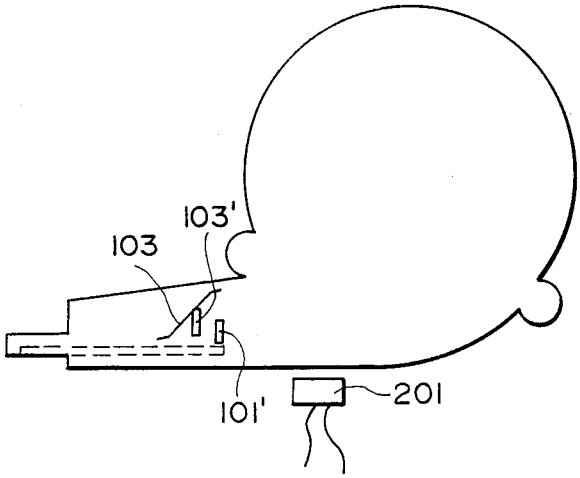
FIG. 13 is a side view illustrating a major part of a stapler according to another embodiment of the present invention.

Referring to FIG. 13, description will be made to a further embodiment wherein a projection 103' is formed from a part of the staple confining member 103 engageable to a trailing end portion 101' of the belt of the staples. After the detection of the emptiness of the cartridge by the detecting means, the stapling operation is continued, but when the remaining number of the staples reaches a predetermined portion, the trailing end portion 101' of the belt engages the projection 103' of the stapling confining member 103, so that the belt is mechanically prevented from being fed, thus requiring staple replenishment. In this structure, the staples in the old cartridge do not remain in the stapler after the old cartridge is removed.

Figure 15:
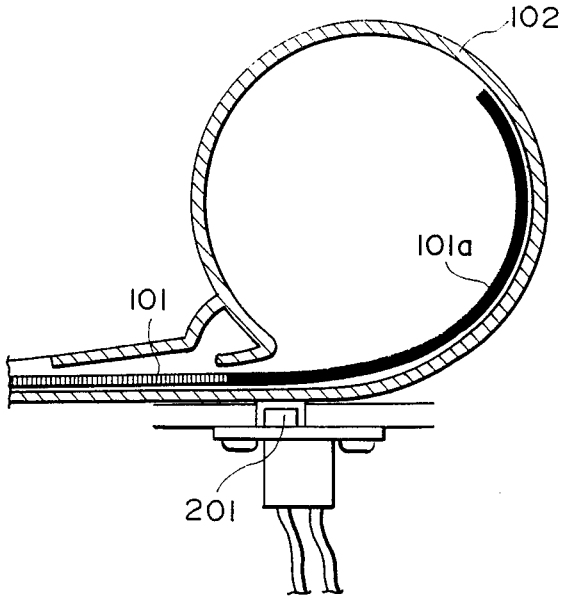
FIG. 15 is a sectional view illustrating a member to be detected for the detection of the emptiness.

As another example, in order to assure the detection of the trailing end portion of the belt by the sensor, the trailing edge portion **101*a* of the staples may be colored in frosted black, as shown in FIG. 15**.

Figure 16A:
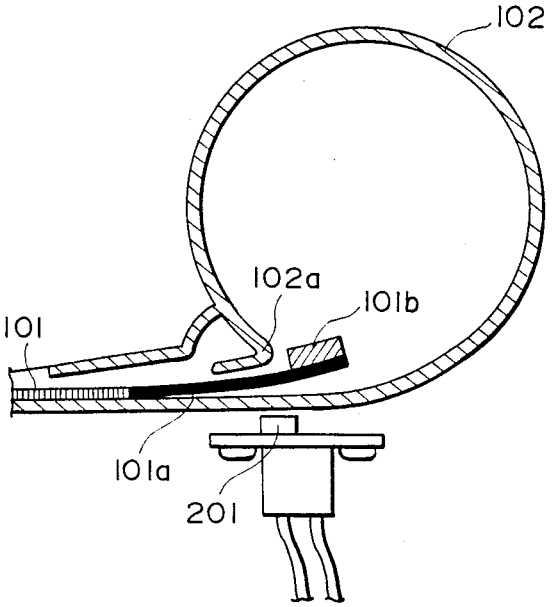
FIGS. 16A and 16B are a sectional view of means for preventing the staples from being discharged out of the cartridge.
Figure 16B:
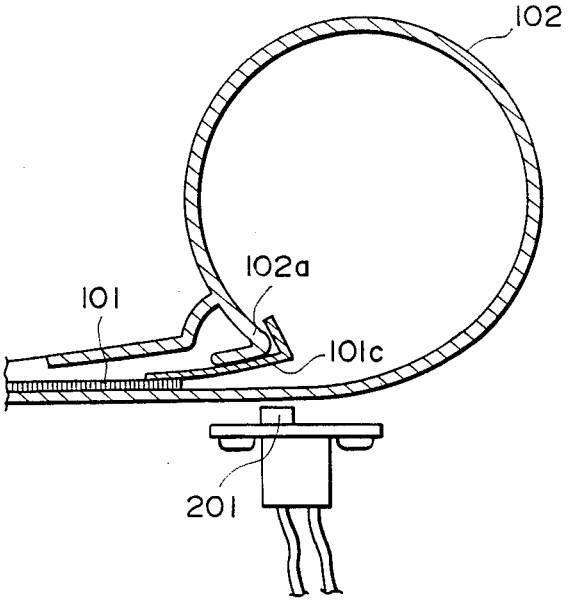

Referring to FIGS. 16A and 16B, when an engaging member is mounted on the trailing edge of the belt of the staples 101 for engagement with the guide **102*a* of the staple cartridge 102, the staples 101 remaining in the cartridge 102 are prevented from leaving of the cartridge 102 to assure that the staples 101** remain therein when the cartridge is removed from the apparatus.

Figure 17:
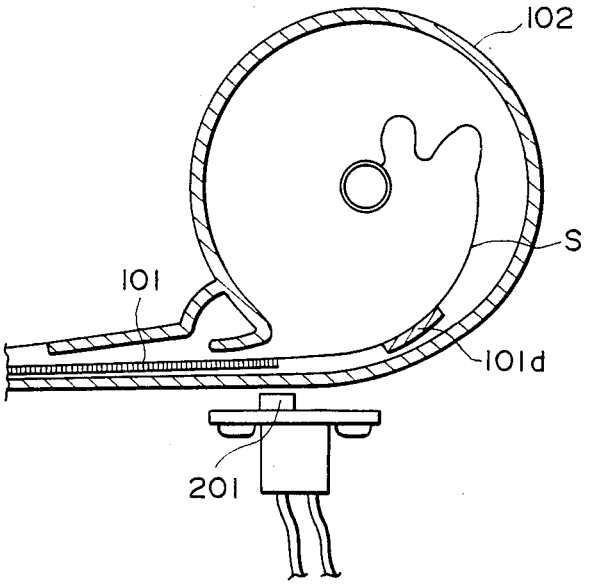
FIG. 17 is a sectional view illustrating another example of a member for detection of the emptiness.

In one of the embodiments, part of the belt of the staples 101 is colored in frosted black, but this is not limiting. For example, as shown in FIG. 17, a sheet material S mounted to the end of the staple belt is provided with substantially black member **101*d* at a position away from the end of the belt and functioning as a detection member. With this arrangement, the staples 101 remaining in the cartridge 102** can be used more efficiently.

As a further alternative, a sheet member can be attached to the belt of the staples 101.

In the foregoing embodiment, the belt of the staples is constituted by straight wires, but this is not limiting and it may be constituted by channel-shaped wires.

Figure 18:
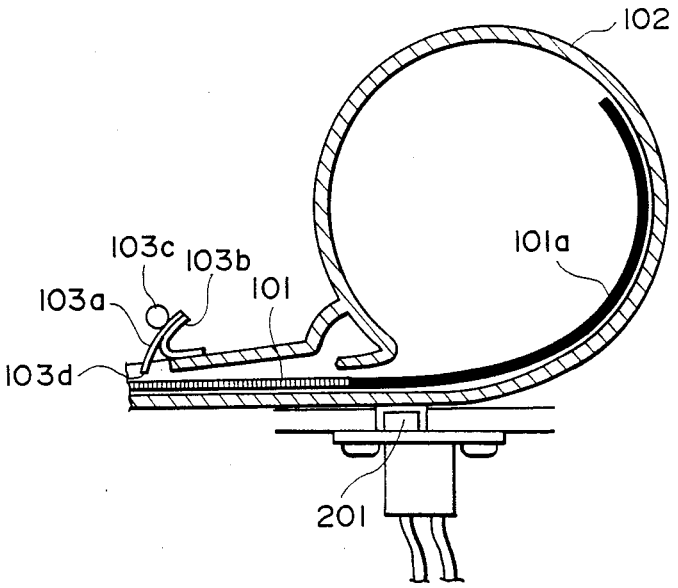
FIGS. 18 and 19 show other examples of means for confining movement of the belt of staples.
Figure 19:
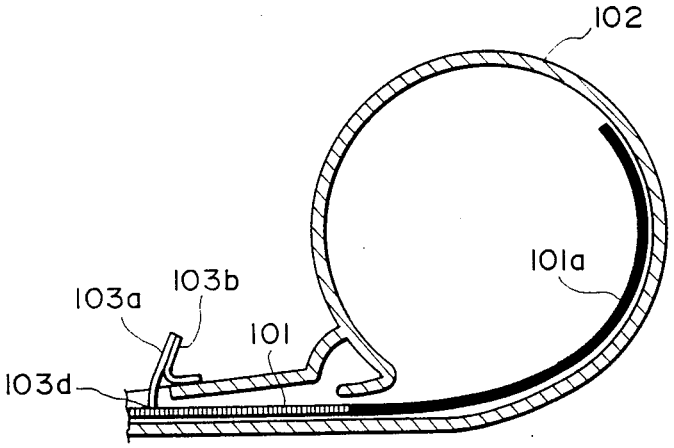

Referring to FIGS. 18 and 19, a further embodiment will be described which includes different movement confining means. A plate **103*a* is fixedly mounted to L-shaped leaf spring 103*b* mounted to the cartridge 102. When the cartridge 102 is mounted to the stapler, the plate 103*a* is pushed by a pin 103*c* fixed to the stapler, by which the leaf spring 103*b* is bent, so that the leading portion 103*d* of the plate 103*a* is spaced apart from the staple 101 and movement confinement is not effected. When, however, the pin 103*c* is spaced apart from the plate 103*a* upon dismounting of the cartridge from the stapler, the leaf spring 103*b* tends to the original shape, and therefore, the leading edge 103*d* of the plate 103*a* is pressed to the staple 101** to confine movement of the staple, so that the staples do not remain in the stapler.

While the invention has been described with reference to the structures disclosed herein, it is not confined to the details set forth and this application is intended to cover such modifications or changes as may come within the purposes of the improvements or the scope of the following claims.

What is claimed is:

1. A sheet stapler apparatus, comprising:

a cartridge, mountable in said sheet stapler apparatus, for containing a belt of connected staple wires, said cartridge being movable from a predetermined position;

movement confining means, provided in said cartridge, for confining movement of the belt;

means for stapling sheet materials with a leading staple from the belt of staple wires;

means for feeding the belt in a forward direction from said cartridge to said stapling means;

detecting means for detecting the amount of staple wires remaining in said cartridge; and control means, responsive to said detecting means for prohibiting said feeding means from feeding the belt, at which time said movement confining means is acting on the belt.

2. An apparatus according to claim 1, wherein said detecting means includes trailing edge detecting means for detecting a trailing edge of the belt as it reaches a predetermined position in said cartridge.

3. An apparatus according to claim 2, wherein said trailing edge detecting means detects the trailing edge of the belt as it reaches a predetermined position upstream of said movement confining means.

4. An apparatus according to claim 3, wherein said trailing edge detecting means includes means for emitting light to the belt, means for receiving light reflected by the staple wires and means for producing a signal.

5. An apparatus according to claim 2, wherein said prohibiting means prohibits said feeding means from feeding the belt after a predetermined number of stapling operations by said stapling means are effected after said trailing edge detecting means detects the trailing edge of the belt.

6. An apparatus according to claim 4, wherein said light receiving means is disposed at a position for receiving light reflected by a portion of the staple wires having a high reflective index.

7. An apparatus according to claim 2, wherein said trailing edge detecting means detects a member integral with the trailing edge of the belt.

8. An apparatus according to claim 1, wherein said movement confining means includes an engageable member for frictional engagement with the belt.

9. An apparatus according to claim 8, wherein said engaging member is spaced from the belt when said cartridge is mounted at a predetermined portion of said stapler apparatus.

10. A sheet stapler apparatus, comprising:

a cartridge, mountable in said sheet stapler, apparatus for containing a belt of connected staple wires, said cartridge being movable from a predetermined position;

movement confining means, provided in said cartridge, for confining movement of the belt;

stapling means, operating in stapling operation cycles, for stapling sheets with a leading staple wire on the belt;

feeding means for feeding the belt from said cartridge in a forward direction to said stapling means with each cycle of said stapling means;

trailing edge detecting means for detecting when the trailing edge of the belt, travelling in the forward direction, reaches a position upstream of said movement confining means by a predetermined distance; and control means, responsive to said detecting means, for prohibiting a stapling cycle by said stapling means after a predetermined number of stapling cycles are effected after the trailing edge is detected by said detecting means, at which time said movement confining means is acting on the belt.

11. An apparatus according to claim 10, wherein said movement confining means includes an engageable member frictionally engageable with the belt.

12. An apparatus according to claim 11, wherein said feeding means is disposed downstream of said movement confining means with respect to the feeding direction of the belt.

13. An apparatus according to claim 10, wherein said movement confining means always confines movement of the belt.

14. An apparatus according to claim 13, wherein the staple wires are connected by a bonding agent, and said detecting means detects the light reflected by a portion of the staple wires without the bonding agent.

15. An apparatus according to claim 10, wherein said movement confining means is movable between a first position for confining movement of the belt and a second position wherein the movement of the belt is not confined.

16. An apparatus according to claim 15, wherein said movement confining means is in the second position, when said cartridge is mounted in said apparatus.

* * * * *

UNITED STATES PATENT AND TRADEMARK OFFICE

CERTIFICATE OF CORRECTION

PATENT NO. : 4,978,045

DATED : December 18, 1990

INVENTOR(S) : Koichi Murakami, et al.

It is certified that error appears in the above-identified patent and that said Letters Patent is hereby corrected as shown below:

COLUMN 2:

Line 10, "staples" should read --are staples remaining--, and "is" should read --are--.
Line 23, "wing" should read --showing--.
Line 62, "2a." should read --pin 2a.--.
Line 63, "2a" should read --2b--.

COLUMN 4:

Line 5, delete "show-".
Line 6, "ing" should be deleted, and "position the" should read --position showing the--.

COLUMN 10:

Line 17, "said apparatus" should read --said sheet stapler apparatus--.

Signed and Sealed this

Twenty-second Day of September, 1992

*Attest:*

DOUGLAS B. COMER

*Attesting Officer*

*Acting Commissioner of Patents and Trademarks*